US005186103A

United States Patent [19]

Gelinas et al.

[11] Patent Number: 5,186,103

[45] Date of Patent: Feb. 16, 1993

[54] PRINTING MACHINE SYSTEM, ESPECIALLY FOR PRINTING ON A WEB OF HEAVY OR THICK STOCK MATERIAL, WITH INTERCHANGEABLE PRINTING CYLINDERS

[75] Inventors: W. Robert Gelinas, Jewett City, Conn.; Arthur J. Leale, Westerly, R.I.; David J. Leitch, Pawcatuck, Conn.; John J. Mellow, Stonington, Conn.; George Rinaudo, North Stonington, Conn.; Ernest H. Treff, Groton, Conn.

[73] Assignee: Man Roland Druckmaschinen AG, Offenbach am Main, Fed. Rep. of Germany

[21] Appl. No.: 898,039

[22] Filed: Jun. 12, 1992

[51] Int. Cl.[5] ..... B41F 7/04; B41F 13/24

[52] U.S. Cl. ..... 101/181; 101/247

[58] Field of Search ..... 101/137, 138, 139, 140, 101/142, 143, 144, 145, 177, 181, 182, 184, 217, 218, 216, 212, 247

[56] References Cited

U.S. PATENT DOCUMENTS

| | | | |
|---|---|---|---|
| 3,259,060 | 7/1966 | Martin | 101/144 |
| 4,046,070 | 9/1977 | Halley | 101/216 |
| 4,458,590 | 7/1984 | Egnaczak | 101/218 |

*Primary Examiner*—J. Reed Fisher

*Attorney, Agent, or Firm*—Frishauf, Holtz, Goodman & Woodward

[57] ABSTRACT

To permit ready exchange of plate cylinder (13) - blanket cylinder (12) printing couples of different circumferences in a printing machine, the blanket cylinder - plate cylinder printing couple is retained in a cassette (8), with adjustment elements (282, 281, 26) to control the throw-off position of the blanket cylinder in the cassette. The adjustment elements are selectively engageable or disengageable against matching adjustment elements (284, 283) in the printing tower (9). The printing tower adjustably supports an impression cylinder (11) located above the blanket cylinder, when the cassette is installed in the tower, so that printing will be from below. Ink application rollers (361, 362, 363) are force-biassed against the respective plate cylinders, and movable in a slide path which is radial with respect to the plate cylinder of the respective diameter, under control of slide feelers (161, 162, 163) engaging a stationary ring (213) in the cassette concentric with the plate cylinder. The impression setting of the impression cylinder (11) is determined by a bearer ring setting element (29) on the cassette, engaged by a support arm (22) for the impression cylinder. The cassette is removable in a removal path (**15*b*) which has an upward movement component, so that it can be picked up by a hoist (17), after removing the web from between the impression cylinder (11) and the blanket cylinder (12**), which is below the impression cylinder, and after swinging the impression-cylinder out-of-alignment with the cylinders in the cassette.

19 Claims, 12 Drawing Sheets

PRINTING MACHINE SYSTEM, ESPECIALLY FOR PRINTING ON A WEB OF HEAVY OR THICK STOCK MATERIAL, WITH INTERCHANGEABLE PRINTING CYLINDERS

FIELD OF THE INVENTION

The present invention relates to printing machinery, and more particularly to a printing machine system, for multi-color printing, particularly adapted on webs of heavy or thick stock material, such as on cartons, cardboard or the like, supplied to the printing system in a continuous web, for subsequent cutting. The system is particularly applicable for multi-color printing on packaging cartons.

BACKGROUND

When continuously printing by means of a rotary printing machine on a web of heavy stock material, such as packaging cartons used, for example, for boxes retaining foods, such as cereals or small boxes, such as medicines, toothpaste or the like, the problem arises that the heavy stock material varies substantially in size and the repetition rate of the printed material, likewise, varies widely. Thus, it is desirable to install printing cylinders, which may be composites such as a plate cylinder-blanket cylinder printing couple, in which the printing cylinders or a cylinder couple can be easily exchanged for cylinders of a different size. It has been customary, heretofore, when exchanging cylinders, to slide them out in a direction axially with respect to the cylinder shafts, and then place the cylinder on a cart or dolly. The cylinders are heavy. A blanket cylinder-printing cylinder couple of the type to which the present invention relates may well weigh over two tons.

THE INVENTION

It is an object to provide a printing system, particularly adapted to print on heavy or thick stock material supplied in form of a continuous web, in which a printing cylinder or a printing cylinder couple if an offset printing system is used, can be easily exchanged without strenuous or complex handling; and to so construct the printing machine that, after, for example, refurbishing individual printing stations of a printing system with cylinders of different size, setting for the cylinders and associated equipment, such as inkers and dampers, if required, can be easily carried out and, preferably, controlled from a remote-control panel. Register of printing information between the printing stations of the printing system should, likewise, be easily obtainable when, after replacement of printing cylinders, previously used cylinders are again reinstalled.

Briefly, each printing station of a plurality of stations of a printing system has a printing tower which retains therein an impression cylinder. The impression cylinder, apart from a throw-off movement, can be moved out-of-position with respect to a printing cylinder, for example the blanket cylinder of a printing couple, when it is desired to exchange the printing cylinder for one of different size. Printing is carried out from below, so that ink from an inker train is transported upwardly to the printing cylinder or, for example, to the plate cylinder of a plate cylinder-blanket cylinder offset printing couple. This arrangement permits positioning the printing cylinder or, if an offset system is used, a plate cylinder-offset blanket cylinder couple in a removable cassette. The removable cassette can be moved in a direction generally parallel to the path of the web on which printing had been carried out, and then away, upwardly, by a hoist system, for depositing, for example, at a cleaning station or for storage. This is far simpler and more rapid than removing the cylinders axially. The entire cassette can be exchanged. The printing tower itself includes a positioning arrangement which, for example, is formed by defined ledges or surfaces against which the cassette fits, so that the cassette can be placed in position. Drive for the printing cylinder is obtained through gears which can be moved axially, for example by air cylinders or the like, into and out of engagement with matching gears on the printing cylinder, or the cylinders of the printing couple, respectively.

In accordance with a feature of the invention, an impression cylinder-printing cylinder throw-off mechanism is provided permitting throwing off the blanket cylinder and the impression cylinder together, by using a common air cylinder. The connections between the tower and the cassette can be automatically engaged, for example by suitable interlocks using locking cams, the position of which can be controlled from a central control console.

The impression cylinder is not force-loaded against the printing, typically the blanket cylinder. Rather, impression setting of the impression cylinder bearer is done by adjustment of the locking mechanism on the cartridge, against which the impression cylinder setting element, when the impression cylinder is in printing position, can engage. This setting can be maintained for as long as the same cartridge for a specific size of cylinder is used in the same print tower.

The setting of the impression cylinder with respect to the blanket cylinder varies with web thickness, and this setting of the relative position of the impression cylinder with respect to the blanket cylinder can be independent and separate from the setting of the respective cylinder bearers. This variation can be controlled from a general control console for all units; additionally, each unit or printing station can be adjusted individually. Usually, the unit adjustment is symmetrical at both axial ends of the respective cylinders; yet, the unit adjustment at the work side of the printing station can be different from that of the gear side, if desired.

In accordance with a feature of the invention, the bearers have wipers so that they will run against each other with clean circumferences. A bearer wiper throw-off is provided which is tied into the cylinder throw-off linkage so that, whenever the impression cylinder is thrown to the OFF position, the bearer wiper moves away from the bearers through a mechanical linkage.

Register is maintained by setting the line shaft and the shafts for the printing stations to a reference or zero line position by use of clutches. The printing system has a plurality of printing stations, and on the last printing station or printing unit proximity switches are provided which identify a zero or null or reference position for the line shaft. When the line shaft is to be brought to the zero position, a small, 3-horsepower drive motor is used to rotate the line shaft at a slow controlled speed, to precisely reach a zero position.

The printing cylinder, and, in a blanket-plate cylinder couple, the plate cylinder, has a separate plating motor which is used to rotate the printing cylinder. This motor is interlocked so that it can operate only when a drive clutch for the particular printing station or printing unit is disengaged. An adjustable slip disk is provided, coupled to two optical sensor marks, picked up by optical sensors. The sensor marks are mounted on the plate cylinder gear. A disk is located on the gear in relation to the cylinder clamping groove for the printing plate which is clamped to the respective printing cylinder. A first mark indicates that a stop point is approaching, and a second mark is at the stop point, which must be within ±1 mm. The positioning of the slip disk on individual cartridges indicates the timing of the unit in relation to the line shaft, so that the clamping groove or cylinder gap is appropriately related to the line shaft. When the clutch is then engaged, the unit is in time.

The printing cylinder can be automatically moved to a plate-change position. This permits easy access to the printing cylinder, so that the plates thereon can be readily exchanged. A second adjustable slip disk is mounted on the plate cylinder gear, which is associated with an optical sensor mark, timed to the plate cylinder gap or clamping groove. The disks is positioned so that the optical sensor mark will stop the press in a position where it is convenient to start the plate change operation, that is, where access to the plate change is readily available to an operator.

The inker is retained in the print tower. This requires that the inker ink application roller is so positioned that it will apply ink to the printing cylinder or, if a printing couple is used, to the plate cylinder. The ink application roller is so arranged that it will not have to be reset when changing the diameters of the printing rollers in the cassette or cartridge. The ink application rollers are force-loaded against a ring which has the same diameter as the plate cylinder gear pitch diameter. A striker is provided, which is part of the application roller hanger. It moves in a straight line to retain the force loading against the ring. The ring does not rotate, but is attached to the cartridge or cassette. The ink application roller or rollers, thus, are only force-loaded agains the ring. A striker element, which is part of the ink application roller hanger system, moves in a straight line. This differs from the prior art which utilized cam profiles which rotated; in contrast, the ring may have the same relation to the cylinder which is actually installed since it has the same diameter as the respective cylinder gear pitch diameter.

For ease of maintenance and control, all pneumatic and electrical positioning and control elements have been removed from the cartridge or cassette, so that all control systems and lines, be they hydraulic, pneumatic or electrical, can be coupled to the tower, which is part of the fixed installation. Thus, no pneumatic, hydraulic or electrical connectors have to be disconnected or disassembled when exchanging cartridges or cassettes.

In accordance with a preferred feature of the invention, the printing systems are offset systems having blanket and plate cylinders. The system of the present invention permits the use of axially long cylinders. Long cylinders cause problems in connection with locking printing blankets on blanket cylinders, and, in accordance with a feature of the invention, torsion bars can be incorporated in the blanket lock-up, so that the loading on each end of the bar can be equalized. This evens out the load on each end of the bar and takes up blanket slack as the offset blanket is run in.

To retain phasing, the system can also use the arrangement in which both the plate and blanket cylinder move when a register move is commanded. This arrangement, known by and itself, reduces the non-print area, over an arrangement in which only the plate cylinder is moved.

In accordance with a preferred feature of the invention, the cassette or cartridge retains both a plate cylinder and an offset or blanket cylinder. The advantage of the offset system over a single printing cylinder system is that the print quality is improved over that of using only a single printing cylinder. The system of the present invention, however, is equally suitable for use in printing installations in which printing is directly from a single printing cylinder.

DRAWINGS

DETAILED DESCRIPTION

Figure 1:
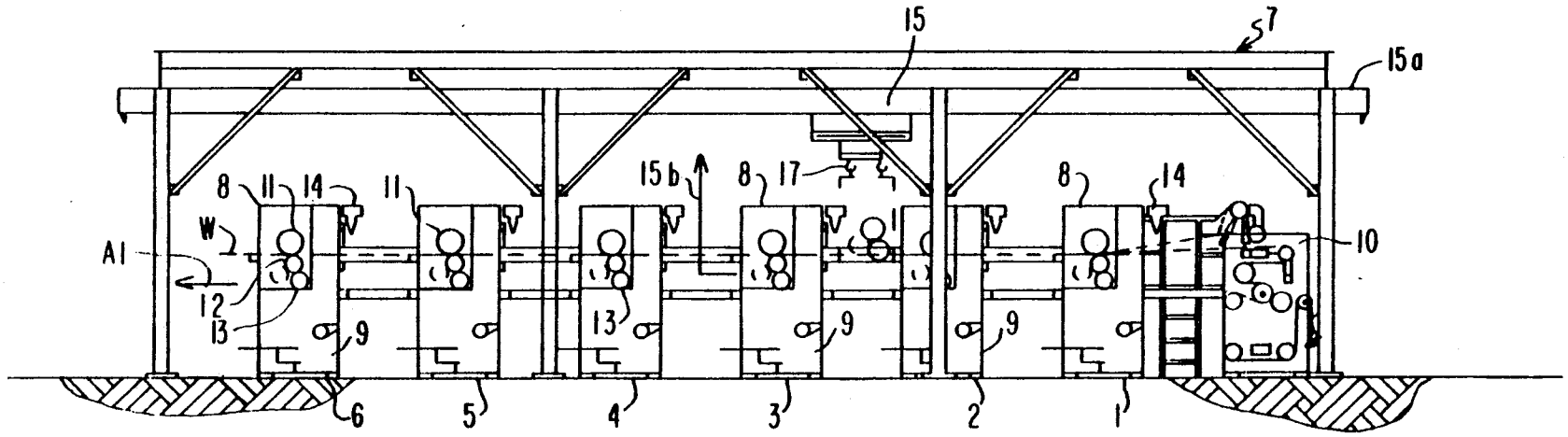
FIG. 1 is a highly schematic front view of the printing system in accordance with the present invention.

The printing system of the present invention is intended to operate on a web W of heavy or thick stock material, typically used for cartons for food products, such as cereals, which may be packed in quite large boxes. The invention is directed, however, also to a system which, in addition to printing from a web on cartons for such large boxes, also provides for printing on carton or box-stock web for small boxes, such as boxes for personal care products, medicaments, or the like. Typically, the web is supplied from an unwinding roll retained, for example, on a standard roll changer, to an in-feed device 10 (FIG. 1), from which the web is guided in an essentially horizontal path. All features not necessary for an understanding of the present invention, such as guide rollers, base supports and the like, have been omitted from the drawing.

The web is fed between a plurality of printing stations or printing units, 1, 2, 3, 4, 5, 6, in FIG. 1 from right to left, as shown by the arrow A1.

In accordance with a feature of the invention, the printing is done at the lower face of the web, and each printing station is constructed as a printing tower 9 into which a cassette or cartridge 8 can be inserted. The printing tower retains and positions an impression cylinder 11, engageable against the top side of the web W. Printing, in accordance with the embodiment selected, is carried out by a printing couple formed of a plate cylinder 13 and a blanket cylinder 12. Both the plate cylinder 13 as well as the blanket cylinder 12 are retained in a removable cassette or cartridge 8. The blanket cylinder 12 prints against the lower side of the web W. Detailed showings of the cassette as well as of the cylinders of the printing units 1–5 have been omitted, since the printing units or stations are all identical.

The overall system, additionally, includes an overhead crane system 7. The crane system 7 carries a movable hoist 15, running on crane ways 15*a*. The hoists 15 carry hooks and cables 17, engageable with the cassettes 8 of any one of the printing units, to remove the cassettes or cartridges 8 in a path which first is generally parallel to, but slightly upwardly with respect to the web W, and then vertically upwardly, as shown by the schematic arrow 15*b*. This removal path has the substantial advantage that the crane way 15*a* can then place the cassette—which may weigh in the order of 2½ tons—at any suitable, readily accessible location, for later handling or storage, without requiring detailed operator attention. By side printing with the impression cylinder on top of the unit, maximum accessibility to the printing couple is obtained, by allowing the press operator to work beneath the web; the arrangement further provides for convenient location of the ink fountain and dampener fountain. Overhead removal is safe, and permits accurate cassette change, even of 2-cylinder cassettes. The arrangement provides for automatic reset of the respective cylinders and rollers in their proper positions.

FIG. 1, additionally, illustrates a web detection and severing element 14, standard in web printing technology, to check correct printing, detect web tears, fissures or the like, or otherwise control the printing process, as well known in the art.

Placing the inker and dampener below the web has the additional advantage that the inkers and dampeners, which are heavy, need not be moved when the cartridge is to be removed. Placing inkers and dampeners at the top side of a tower construction may introduce vibration, and consequent roll streaking, and requires lateral, axial removal of printing cylinders, such as plate cylinders and blanket cylinders, when the diameter of the cylinders, also referred to as the cylinder cut-off size, which determines the length of the maximum printing image which can be accomodated by the cylinder, is to be changed.

Figure 2:
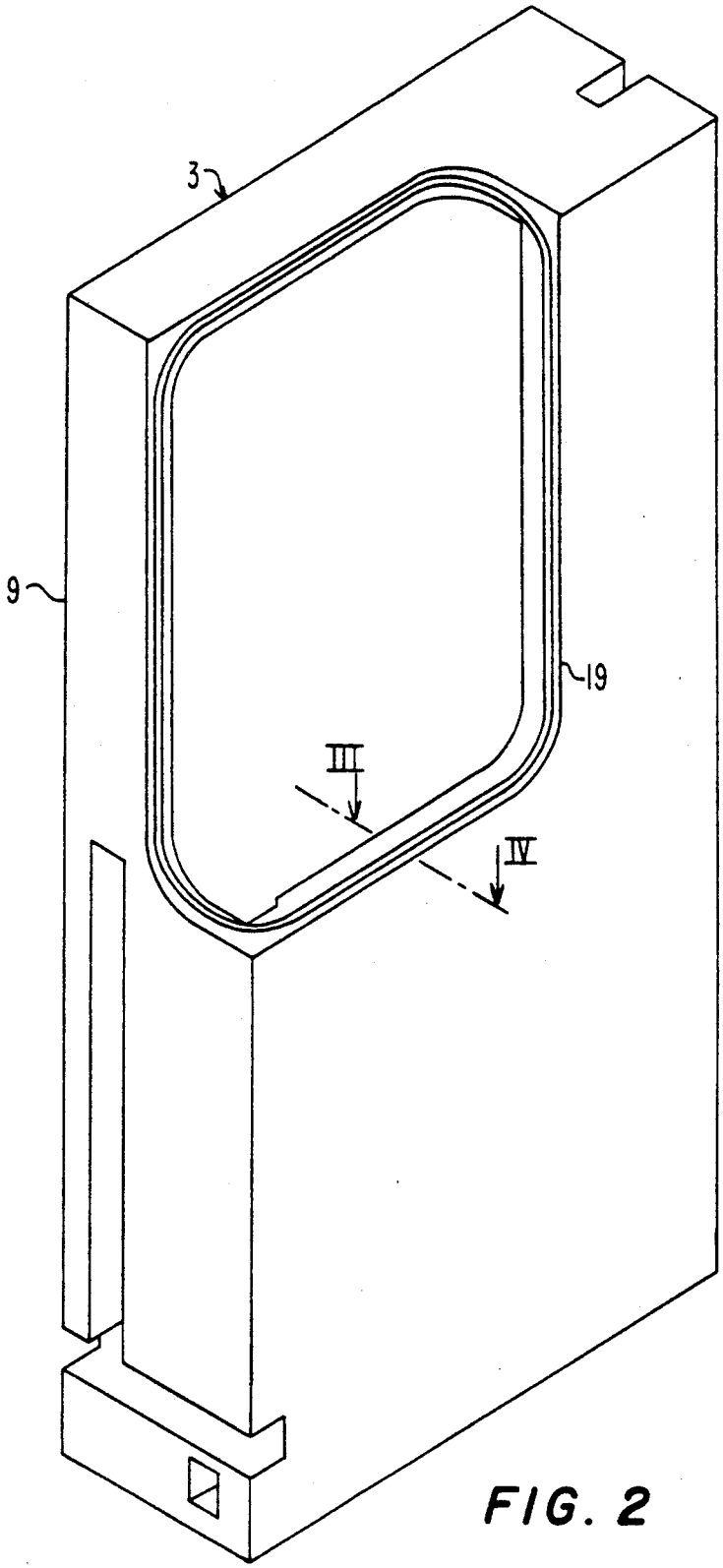
FIG. 2 is a schematic pictorial view of one of the print towers, forming a printing station or printing unit of the system of FIG. 1, in which all elements interiorly of the tower have been removed.

FIG. 2 is a highly schematic view of one side of a print tower, for example of tower 3, with the cartridge 8 removed. All structural elements within the print tower, such as linkages for the impression cylinder, the cylinders themselves and the like, have been removed for visibility; only one side of the tower frame, with the locating surface 19 for the cartridge or cassette 8, is shown.

The cartridge 8 itself is formed of a matching unit (see also FIG. 11) fitting into the opening bounded by the surface 19. The print tower portion 9 which is shown in FIG. 2 is the tower frame portion of the gear side 9, which includes a cover shield. The gears are oiled, and the gear side includes the shield to prevent oil leakage. The other side or portion of the tower, side 9' (FIG. 11), is the work side where the gears do not include any oil, but the bearings are self-oiled. The work side is hollow, and retains electrical, pneumatic and hydraulic systems, but no oil. In FIG. 11, the outliine of the cassette 8 at the work side has been omitted for clarity. Bearings, likewise, have also been omitted. FIG. 11, additionally, illustrates the center of the main drive worm gear box 57, as well as the center 46 of the main line and drive shaft shown schematically in FIG. 10. Portions 9, 9' of the tower are suitably connected, as well known. Connections are omitted from FIG. 11 for clarity.

Figure 3:
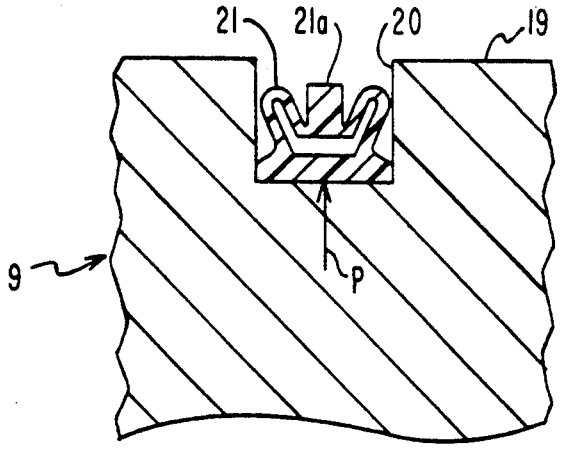
FIG. 3 is a detail sectional view along line III—III of FIG. 2, illustrating an insertion seal.

The frame 9 includes a surface 19 which, entirely apart from forming a positioning structure for the cassette, also provides for a seal, as best seen in FIG. 3. The frame is formed with a circumferential slot 20, into which a hollow rubber tube or seal 21 is placed and attached, e.g. glued. The rubber seal 21 is pressurized, as schematically shown by arrow P (FIG. 3) through a valve, similar to a Schraeder valve, used on bicycle or car tires, which expands the hollow tube 21 and presses a central rib 21*a* against a cassette 8 inserted into the frame opening defined by the wall surface 19.

Typically, the hoist 15 carries four hook-and-cable positions and the cassettes or cartridges 8 have fitting attachment arrangements, in accordance with any well known and suitable construction.

Figure 4:
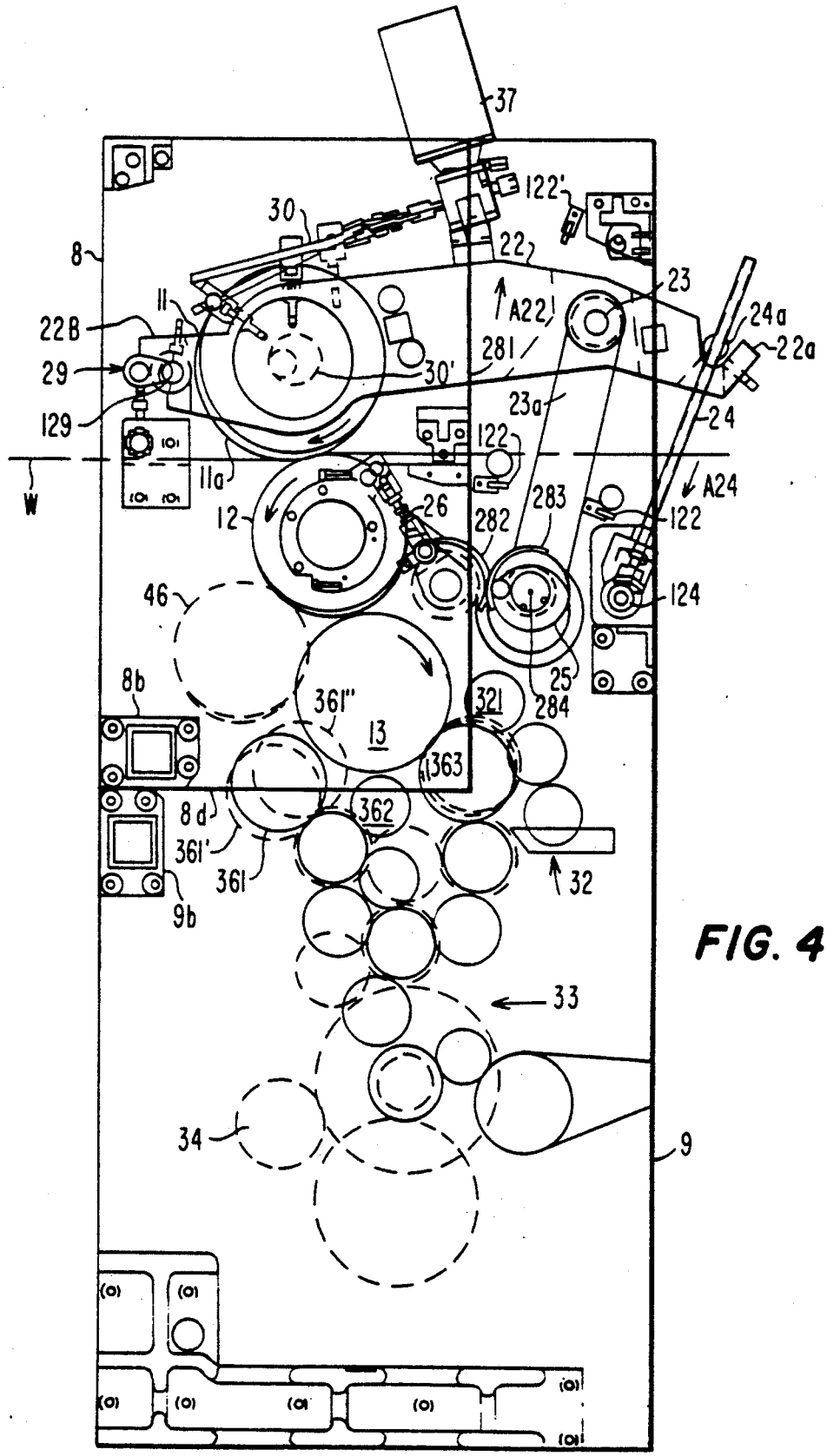
FIG. 4 is a schematic layout view a print tower with a cassette installed, in which the impression cylinder and an offset cylinder are in printing position.
Figure 5:
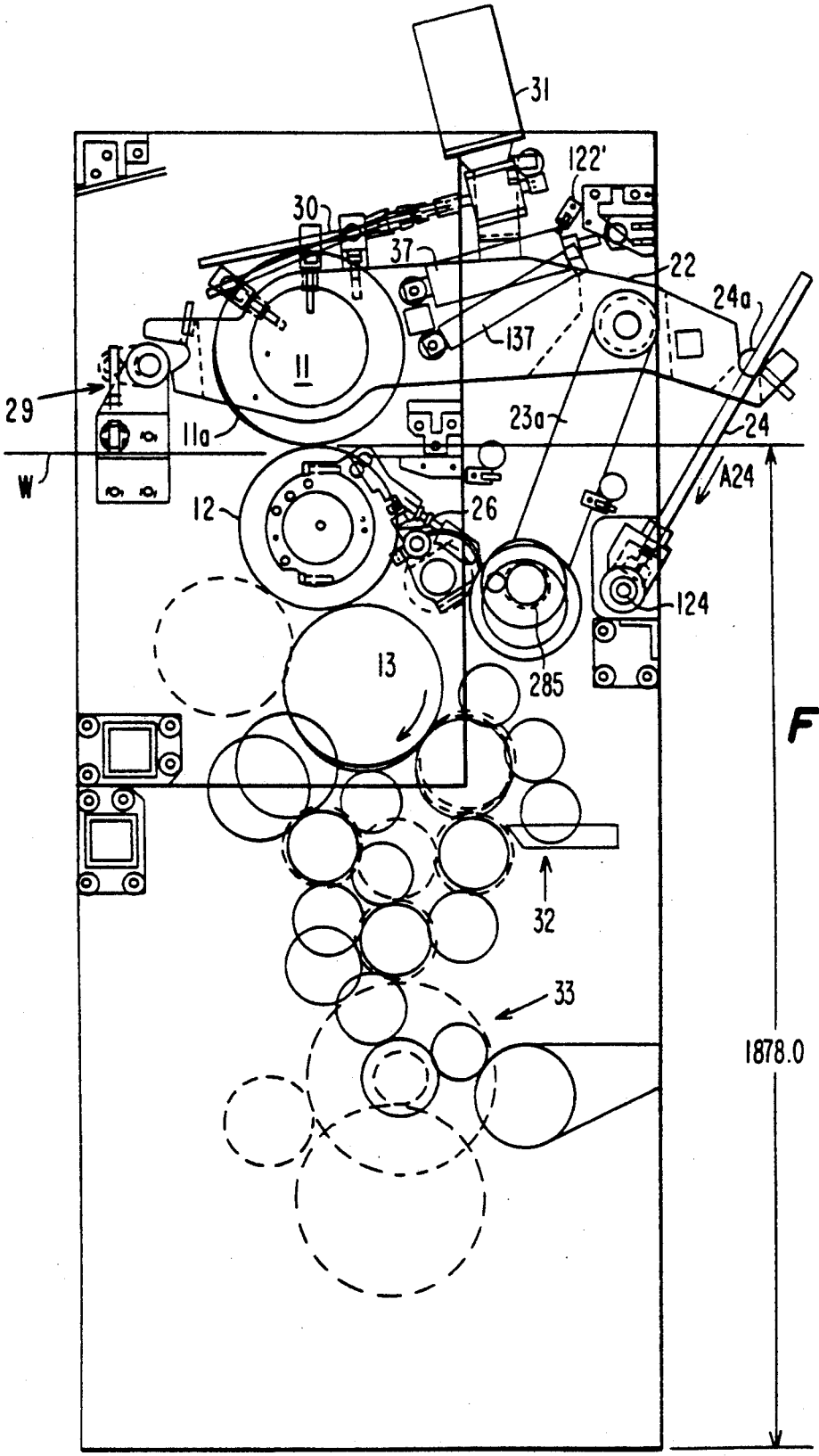
FIG. 5 is a view similar to FIG. 4, illustrating the first step in removal of the cassette from the printing tower.
Figure 6:
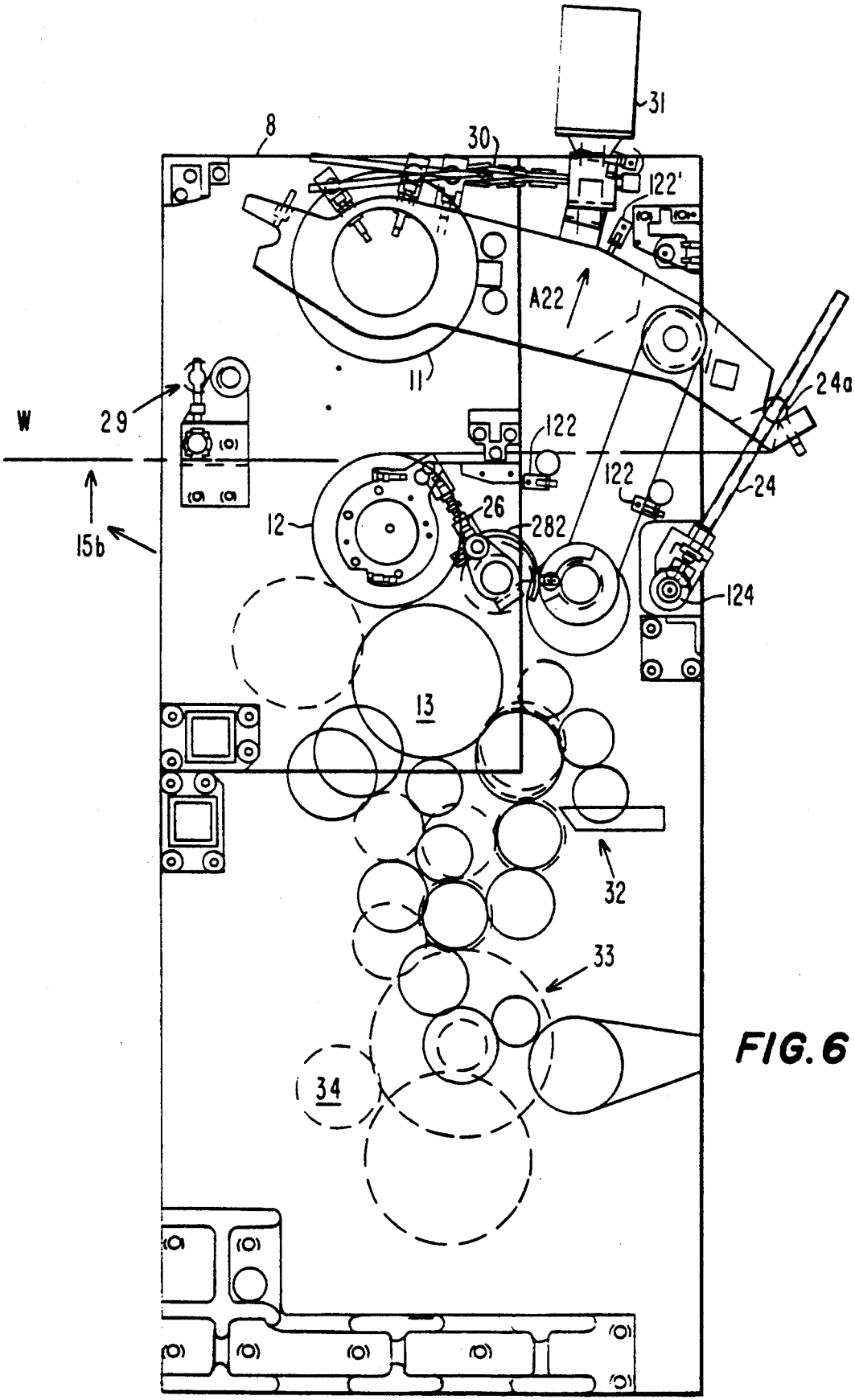
FIG. 6 illustrates a next step prior to removal of the cassette from the printing tower.

Referring now to FIGS. 4, 5 and 6:

The printing machine stations or units 1–6 illustrated in the drawings can, variably and interchangeably, accept plate and blanket cylinders having different diameters, in which the diameters can vary for example from about 12–21 cm. FIG. 4 illustrates a blanket cylinder 12 and a plate cylinder 13, both of intermediate size. It shows the cassette 8, with its locating edge 8*a*, which fits against the surface 19. In FIG. 4, the cassette edges are shown straight although, as best seen in FIG. 2, the edges are curved for ease of placement of the pneumatic seal 21 and for insertion. FIGS. 4, 5 and 6 are schematic.

The impression cylinder 11 is retained on two impression cylinder arms 22, one in each tower portion 9, 9', respectively. Each one of the tower portions has similar arrangements of bearings and/or retention arms or support elements, to retain the respective cylinders and other elements in position. Only one of those arrangements will be described for simplicity.

Impression cylinder 11 thus is retained on arms 22. The arms 22 can pivot about a pivot 23. Pivot 23 is not fixed in position in the tower 9 but, rather, can shift its position by movement of eccentric 25. The position of the impression cylinder body 11 can be adjusted with respect to the impression cylinder bearer 11*a* by movement of an eccenter control linkage 30 and an eccenter 30' shown only schematically, under control of motor 31. The impression cylinder bearer adjustment 29, formed by an eccentric pin 129 to adjust bearer 11*a* with respect to a blanket cylinder bearer 12c (FIG. 11), is secured to the cartridge or cassette 8, and does not form part of the tower 9, 9'.

The arms 22 can be pulled forwardly and backwardly for engagement with, or disengagement from the impression cylinder bearer adjustment block 29 by air cylinders 37, see FIG. 5, omitted from FIG. 4 for clarity. A dashpot 137, likewise-coupled to the arms 22, assures soft and gradual movement. The travel of the arm 22 is monitored by a microswitch 122'.

Upward movement of the arm 22 in the direction of the arrow A22 (FIG. 6) is controlled by a motor 124, rotating a geared spindle 24, which is in engagement with a hollow internally threaded ball 24a, shown best in FIG. 6. Upon rotation of the motor 124 to turn the spindle to move the ball 24a downwardly, see arrow A24, FIG. 4, the arm 22 will be raised in accordance with the arrow A22 (FIG. 6).

The pivot point 23, about which the arm 22 is raised, is secured to a link 23a. The position of the link 23a can change, in dependence on whether the impression cylinder 11 and plate cylinder 12 are in PRINT-ON or THROW-OFF position, as will appear. The position of the arm 22 is determined by engagement of the forward end 22b thereof with the impression cylinder bearer adjustment 29.

The blanket cylinder 12 is retained in suitable bearings, at both ends (see FIG. 11) in two lateral side portions of the cassette 8, of which only the side portion at the gear side 9 of the tower structure is seen. A symmetrical side portion is also located at the work side, but has been omitted from FIG. 11 for clarity. Suitable framing members to connect the side portions together, likewise, have been omitted, since they may be of any structural shape appropriate to retain the side portions of the cassette together. The side portions may be frame elements or plates.

Figure 7:
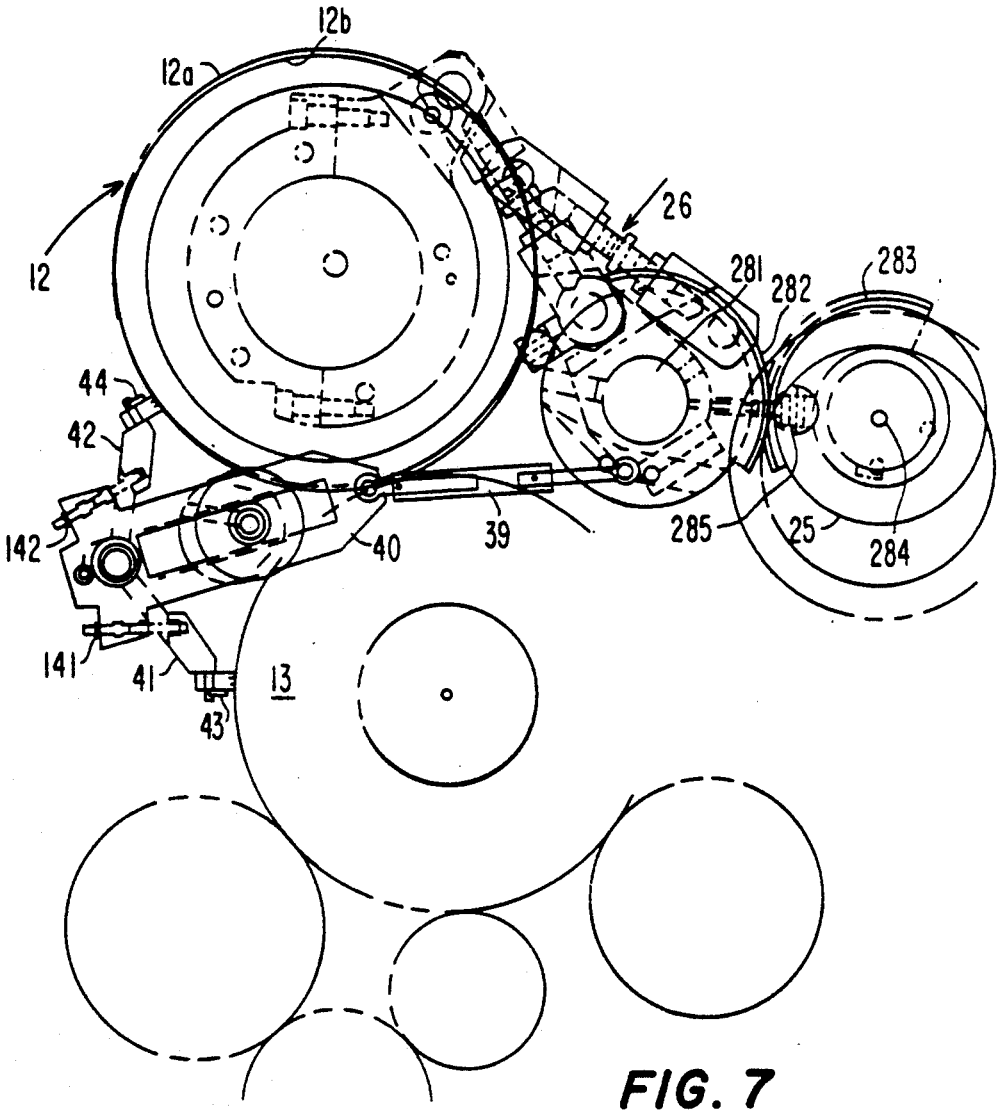
FIG. 7 is a detail view illustrating the bearer wiper and plate-blanket throw-off arrangement, in highly schematic representation.

The blanket cylinder 12 can be thrown off by a linkage 26, shown in greater detail in FIG. 7. The linkage 26 is coupled to a throw-off shaft 281, which is coupled to a gear segment 282, meshing with a gear segment 283. Gear segment 283 is coupled to a second throw-off shaft 284. The gears 282, 283 form timing gears so that the throw-off shafts 281 and 284 will move together. The gear segment 283 on the second throw-off shaft 284 can be shifted axially by an axial pneumatic cylinder 285, to establish or disconnect engagement between the gears 283, 282. The shaft 281 is part of the cassette; the shaft 284 is retained in the tower 9. The axially operating cylinder 285 provides for disengagement of the gear segments 282, 283 when the cassette is to be removed.

The shaft 284 is further coupled to an eccenter 25, which is the impression cylinder throw-off eccenter. The eccenter 25 changes the position of the linkage arm 23a. Consequently, upon rotation of the shaft 284, the impression cylinder 30 will be thrown OFF due to the change in the pivot position of the pivot 23 at the same time that the blanket cylinder is thrown OFF due to rotation of the gear segments 283–282, and consequent rotation of the shaft 281. The ball or pin connection 24a between the spindle 24 and the forked end 22a of arm 22 is so set that the ball 24a sits loosely in the forked depression of the end 22a to permit shifting of the pivot point 23 when the eccenter is rotated.

The cassette 8 is locked to the tower 9 by locking elements 8b, 9b, shown only schematically in FIG. 4, and also at the same time forming end portions for cross-connecting channel sections to connect the gear side and work side portions 9, 9' of the tower as well as of the cassette, together.

FIG. 4 additionally illustrates, schematically, a dampener 32 and an inker 33. The inker receives ink from a standard ink supply arrangement, and applies the ink to a plurality of rollers 361, 362, 363. The ink application roller 363 is also in engagement with a damping liquid application roller 321 to provide, at the same time, ink and dampening fluid to the surface of the plate cylinder 13. The ink application roller 361, in full-line position, illustrates the position of the ink application roller when in engagement with a plate cylinder 13 of the size shown in FIG. 4. In addition, two broken-line positions of the ink application roller 361 are shown, one for a plate cylinder 13 of maximum circumference, and indicated at 361'; and the other for a minimum diameter plate cylinder shown at 361''. Others of the ink application rollers, namely rollers 362, 363, likewise, can shift in position about the center of rotation of the plate cylinder 13 to provide for engagement. In the inker train 33, those inker rollers which are vibrating rollers are shown in full-line circle representation, surrounded by a broken-line circle.

Removal of a cassette from the tower

Let it be assumed that the impression cylinder 11, the blanket cylinder 12 and plate cylinder 13 are in the positions shown in FIG. 4. Before removal of cassette 8, the web W is removed, for example severed or pulled clear of the printing station. The air cylinder 285 (FIG. 7) is energized to axially disengage gears 282 and 283. Drive gear 47 (FIG. 9A) to the plate cylinder 13 is disengaged from a main drive gear 46, e.g. by a clutch.

The cassette 8 can now be removed. The link 22 is pulled to the left to disengage the impression cylinder bearer adjustment 29 from the left-hand tip 22b of the arm 22, see FIG. 5. This is done by the cylinder 37, with the movement being damped by dashboard 137. The arm 22 is now free from engagement with the cylinder bearer adjustment 29. Motor 124 is then energized, causing spindle 24 to rotate in a direction to pull the pin or ball 24a downwardly in the direction of arrow A24. This rotation is continued until—see FIG. 6—the arm 11 is raised substantially in the direction of the arrow A22. Motor 31 for the impression cylinder body adjustment 30 travels with the link 22.

As can be clearly seen, the link 22 and the impression cylinder are now clear from the blanket cylinder and plate cylinder couple. The hoist 17 (FIG. 1), by slightly lifting the cartridge while moving the hoist in a direction away from the tower, can remove the cartridge 8 from the tower, in a lifting path shown schematically by arrows 15b. The horizontal portion of travel, if required, should be large enough to clear the right-hand part (with respect to FIG. 6) of the cartridge 8 from the impression cylinder 11. The impression cylinder bearer adjustment 29 is part of the cartridge and travels with it. Also traveling with the cartridge is the blanket cylinder 12, the impression cylinder throw-off linkage 26, shaft 281 and segmental gear 282, as well a bearer wiper system, described below in connection with FIG. 7. The impression cylinder 11 is preferably not driven. It is carried along by friction as the web W travels.

With the cartridge 8 removed, another cartridge or cassette with a plate cylinder 13 as well as a blanket cylinder of different diameter can be inserted if, for example, a printing job requiring printing for boxes of substantially smaller or larger size is next required. By placing the plate cylinder and blanket cylinder below the web, it is easy to move the impression cylinder out of the way, particularly if it is not driven. Essentially vertical removal, preferably with a removal path first roughly in the plane of the web, and subsequent lifting of the cassette, establishes a path of movement which can be controlled automatically, for example by a program under which the hoist 17 operates.

The cylinders can be quite long, and, in one operative embodiment, the press can be designed for printing on stock which is about 57 inches (about 1.45 m) wide. This is substantially wider than presently known printing machines capable of handling heavy or thick stock material, suitable for packaging cartons.

The impression cylinder 11 can be shifted with respect to an impression cylinder bearer ring shown in FIGS. 4, 5 and 11. The bearer ring is needed to stabilize the cylinder combinations, that is, impression, blanket and plate cylinders. The shifting of the impression cylinder with respect to its bearer, for example by an eccentric 30', is needed to accomodate different thicknesses of stock material of the web W, without, however, interfering with the setting of the bearer 11*a* of the impression cylinder with respect to the bearer on the blanket cylinder 12.

To reinsert a new cassette, e.g. with a cartridge of different cut-off size, it is only necessary to reverse the insertion procedure.

Combined Throw-off of impression cylinder and blanket cylinder 12, with reference to FIG. 7

A rotary drive, for example an air cylinder 285 coupled to the shaft 284—and shown only schematically in FIG. 5—rotates the shaft 284 which, by virtue of engagement of the segmental gears 283, 282, rotates shaft 281. The linkage 26 transfers the movement of the segmental gear 283 to an eccenter throw-off. The difference between the print-ON and throw-OFF position is shown in FIG. 7 by the two adjacent circles 12*a*, 12*b* of the blanket cylinder 12. At the same time, a bearer wiper link 39 is moved, by pulling on a bearer wiper slide 40. The slide 40 carries bearer wiper holders 41, 42 for the bearer wipers 43, 44, engaging the bearer rings of the plate cylinder 13 and blanket cylinder 12, respectively. Spring elements 141, 142, for example spiral compression springs, the tension of which is adjustable by an end nut, press the respective bearer wipers 43, 44 against the respective wiper rings not visible in FIG. 7.

FIG. 7 illustrates the throw-off linkage 26 when the impression is ON in solid lines, and when the impression is OFF, in broken lines for ease of visualization.

Since the impression cylinder throw-off motor 285 rotates the shaft 284, the eccenter which couples the shaft 284 to the link 283 will also shift the pivot point 23 (FIG. 4) to the link 22 so that, when the blanket cylinder is thrown off, the impression cylinder, likewise, will be thrown off. When the cassette is installed, the ball or spindle nut 24*a* coupled to spindle 24 is loose, to permit shifting of the pivot 23. The impression cylinder 11 is held in position by engagement with the bearer adjustment 29. The bearer cylinder linkage operates like a toggle and the cylinders are held in position by the toggle effect, in combination with their substantial weight. Adjustment of the impression cylinder with respect to its bearer is handled with the impression ON. The cylinders tend to rotate towards the impression ON position.

A general control console provides for sequencing and interlocking to permit removal of the cartridge only with the impression ON. Since the impression cylinder, however, is also out of the way upon rotation of the spindle 24, the cartridge 8 can be readily removed. Upon reinsertion, and re-placement of the impression cylinder to the position shown in FIG. 4, engagement of the impression cylinder bearer with the blanket cylinder bearer will then be assured.

The web thickness of cartons which can be handled by the machine may vary, for example between 0.01 to 0.03 inches thickness (0.25 to 0.75 mm). Since the impression cylinder body is set to the blanket cylinder separately from the bearer—see the eccentric on the impression cylinder—accomodating different thicknesses of the web W is easy. This readjustment of the impression cylinder body with respect to its bearer by the motor 31 can be controlled from a central operating console jointly for all the printing stations 1–6; additionally, each unit can be adjusted individually. The unit or station adjustment permits setting of the impression cylinder at the work side independently from the gear side, if desired.

The bearer wiper throw-off mechanism—see FIG. 7—keeps the bearers 12*c* and 13*c* (FIG. 11) for the respective plate and blanket cylinders 13, 12 clean. By tying in the bearer wiper throw-off into the throw-off linkage, due to coupling the bearer wipers 43, 44 to a wheel coupled to the segment 282, the bearer wipers are moved away from the bearers at the same time when the impression is thrown to OFF position. FIG. 6 illustrates the position of the throw-off linkage 26 in OFF position; the bearer wipers are not shown in FIG. 6 for clarity.

Figure 8:
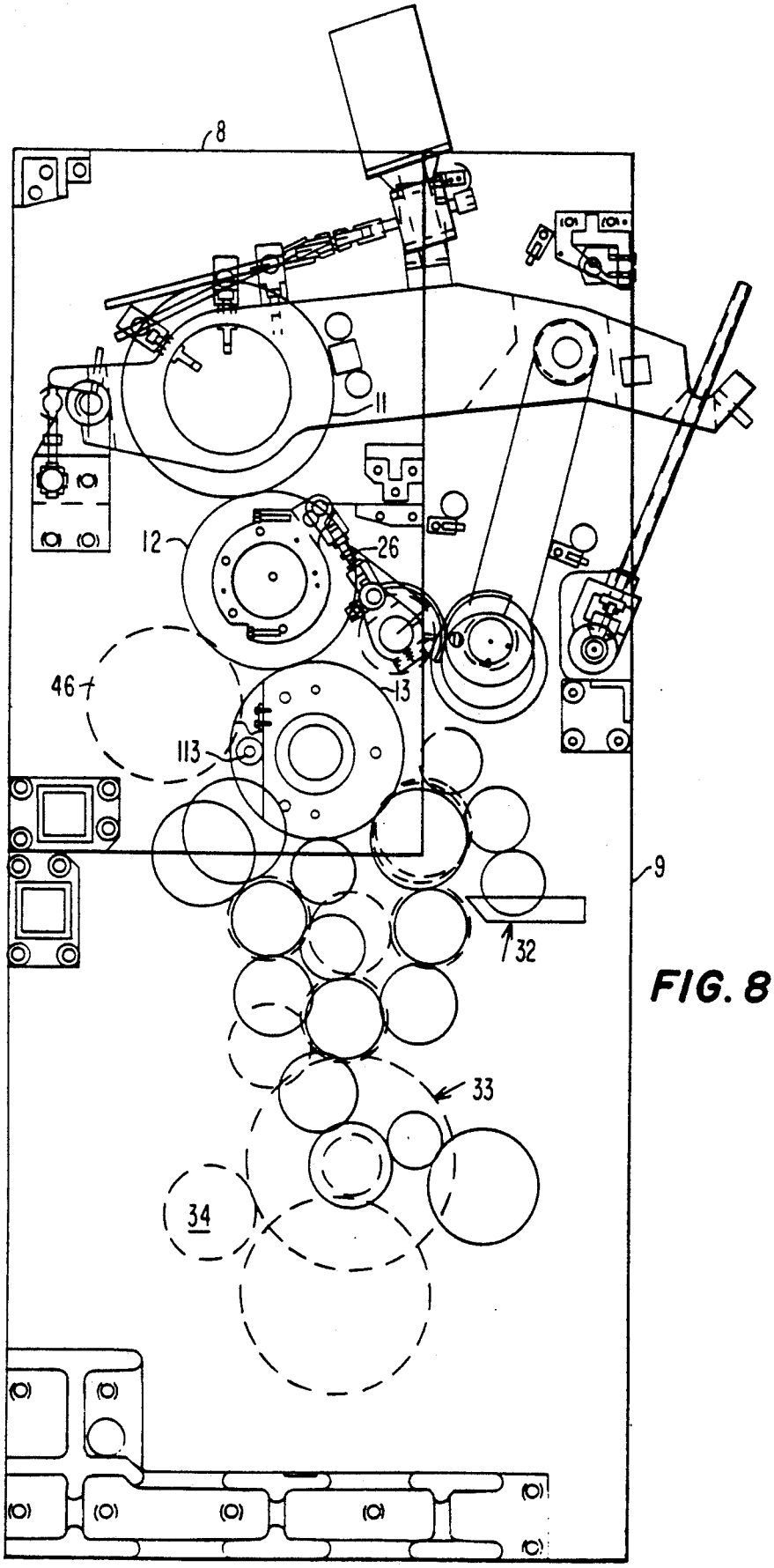
FIG. 8 is an illustration similar to FIG. 4, and illustrating details of the plate lock-up mechanism omitted from FIG. 4.

When the cartridge 8 is removed, it is desirable to lock the plate cylinder in position, in such a way that the plate cylinder gap, forming a groove to attach the printing plate to the plate cylinder, is in readily accessible position, that is, with respect to FIG. 8, facing the left side. A drive gear 46, the center of which is also seen in FIG. 11, includes a clutch. Thus, the drive gear can be referred to as a gear clutch, for selective engagement with the plate cylinder 13. FIG. 8 illustrates the position of the plate cylinder 13 at which the gap, including the plate lock-up mechanism 113, is in a readily accessible position. To rotate the plate cylinder to bring the lock-up mechanism 113 into the position shown in FIG. 8, a plating motor 34, coupled to the gearing of the inker train 33, can rotate the plate cylinder 13. Of course, the gear clutch 46 is then disengaged so that no drive from a main drive shaft, schematically indicated at 157 (FIG. 11) will be transmitted. Once the position of the gap 113 is established, it will not change, due to inertia of the elements, even upon removal of the cassette 8 from the tower 9. The plating motor can also be used to slowly rotate the inker rollers, for example for cleaning.

Figure 9B:
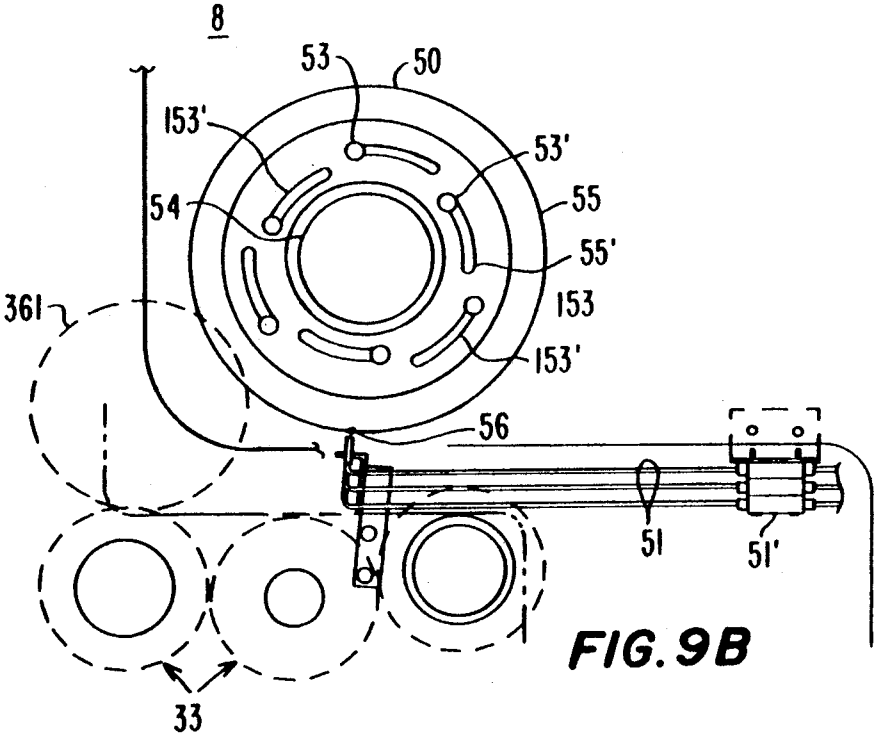
FIG. 9B is an end view, schematically illustrating adjustment of the timing clutch.
Figure 9A:
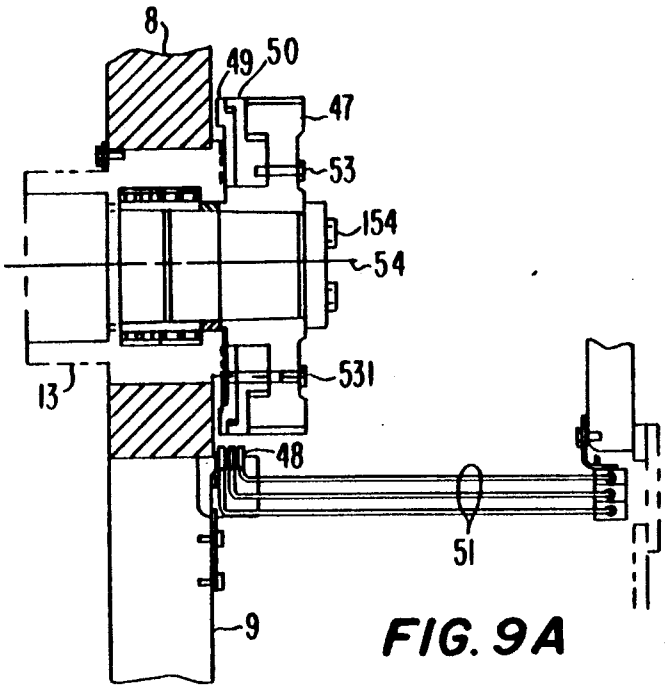
FIG. 9A is a highly schematic vertical sectional view illustrating timing of the plate cylinder with respect to the plate cylinder drive gear.
Figure 12C:
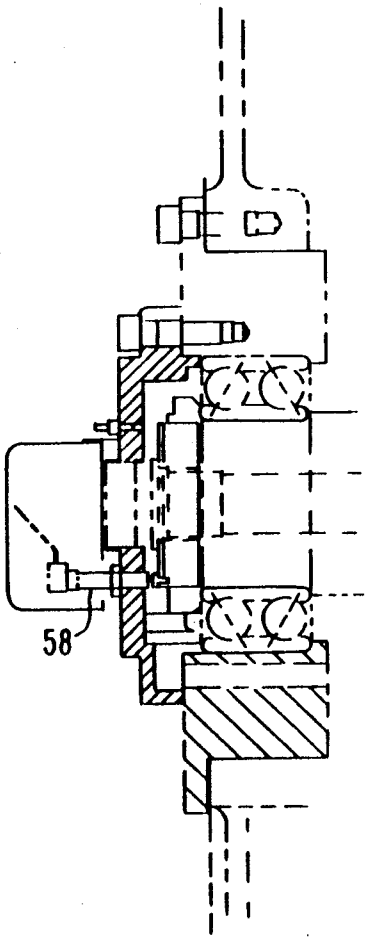
FIG. 12C is a schematic vertical sectional view illustrating the arrangement of FIGS. 12A and 12B.
Figure 12B:
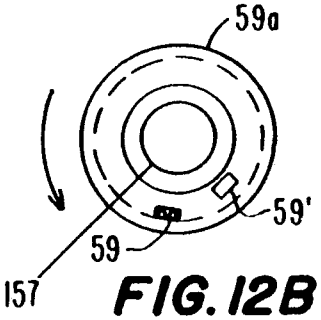
FIG. 12B is an end view of a timing ring, not visible in FIG. 12A.
Figure 12A:
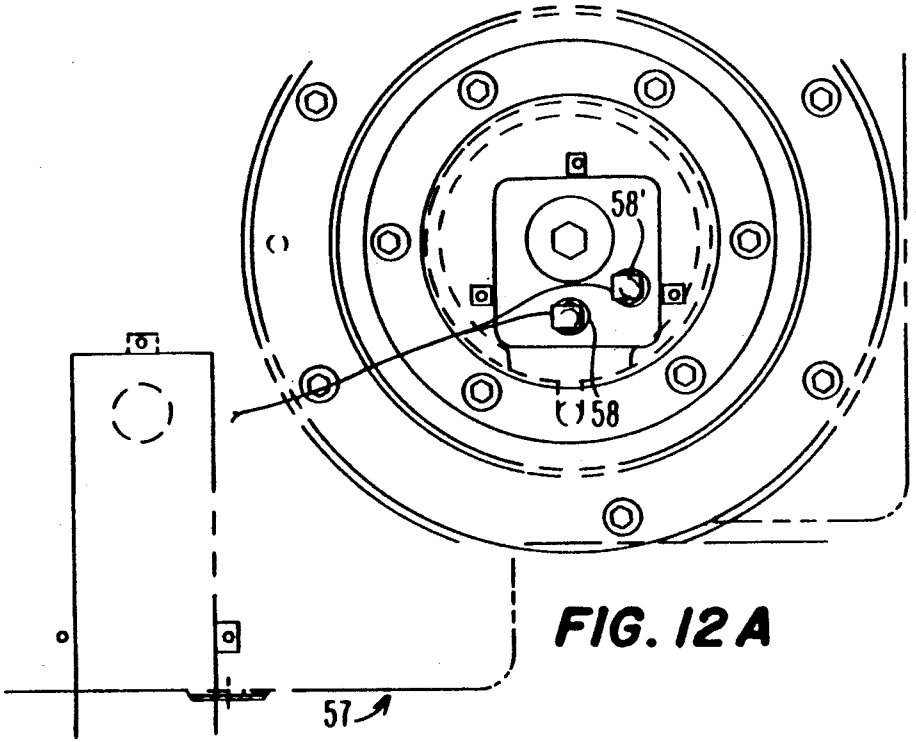
FIG. 12A is an end view of the main gear box, illustrating position of sensors to adjust for timing.

When a cassette is installed, it is necessary to synchronize the gears of the main line shaft and the gears of the respective cylinders and rollers in the cassettes. FIGS. 12A to 12C illustrate the general arrangement to set the zero line shaft and zero unit positions for engagement of clutches. FIGS. 9A and 9B illustrate the printing cylinder timing.

The line shaft 157 can be rotated at a very slow or creep speed, for example by a separate positioning motor of, for example, only 3 HP power rating. The plating motor 34, i.e. for plate cylinder 13 (FIGS. 4–6), which, typically, is 5 HP, is used to rotate the printing unit. The plating motor can operate only when the unit drive clutch, that is, the clutch coupled between the shaft 157 and the main gear 46, is disengaged.

Printing cylinder adjustment

An adjustable disk 50 carries two optical sensor marks 55, 55' on its circumference. The adjustable disk 50 is mounted on the plate cylinder gear 47 which is connected to shaft 54 of plate cylinder 13. An additional disk 49 is mounted on the gear 47, carrying a single circumferential marker. The gear 49 is used to establish the position of the gap 113 in the plate cylinder 13. The disks 49, 50 are secured to the gear 47 by bolts 53, and tightened against the gear. The disk 50 can be shifted circumferentially along slits 153. To move the disk for a circumferential dimension longer than the slits 153, the bolts can be removed and reset in adjacent slits. A single marker 56 is located on the disk 49.

Optical sensors 48 are located in position to pick up or sense the passage of the markers 55, 55', 56, respectively, on the respective disks. The optical sensors, of which three are provided, are coupled through fiber optic lines 51 to a sensitivity setting element 51', which may include an amplifier, for subsequent coupling of the signals derived from the respective markers 55, 55', 56 to a central control console, for control of the motors, that is, the creep motor to set the cylinder shaft position via gear 47, and, when the line shaft position is known, to thereby set the position of the plate cylinder 13.

The first one of the markers 55, 55' which is sensed by the appropriate sensor 48 indicates that a stop point is approaching. The second mark is the actual stop point, at which the shaft must stop within ±1 mm. The positioning of the respective disk 49, 50 indicates the timing of the unit in relation to the line shaft. When the line shaft is timed, and the clutch to the line shaft then is engaged, the unit is in time.

The units have individual motors, independent of the motor of the drive shaft. The motors 34 on the units or stations 1–6 provide this specific drive.

The plate cylinder 13 is automatically moved to plate change position this way: The disk 49 is mounted on the plate cylinder gear, although it can be mounted elsewhere, and coupled to the plate cylinder gear. The sensor mark 56 is timed, or positioned with respect to the plate cylinder gap. The disk is so positioned that when the respective sensor 48 senses passage of the mark, the plating motor 34 will stop the press in a position where it is convenient to change a printing plate on the plate cylinder, e.g. in a 9 o'clock position.

The sensors 48 as well as the cabling connection are mounted on the tower 9. The gear 47 and the disks 49, 50 are on the cartridge, so that the relationship of the shaft 54 and the disks with respect to sensors 48 will always be the same, regardless of the size of the plate cylinder 13.

To distinguish the setting of the respective markers for the zero shaft position and for the plate cylinder stop position, the respective bolts 53, 53' are radially offset with respect to each other and the respective slits 153, 153' are likewise radially offset. FIG. 9B also shows, in broken lines since not material to an understanding of the particular feature, the ink application roller 361, which forms part of the tower and not of the cartridge 8.

The gear 47 is seated on the shaft 54 by a conical seat, and attached by bolts. The conical seat permits adjustment and provides for centering.

The line shaft 157 is positioned with respect to all the units by two sensors 58, 58', see FIGS. 12A, 12B, 12C. A disk 59*a*, similar to disk 50 and carrying two sensing blocks 59, 59' is secured to the line shaft 157. The line shaft 157 is rotated at a slow speed or in a creep mode, until the sensor 58 responding to the marker 59 provides a signal, at which point the motor is stopped, and the position of the gear at its null or zero position, opposite the sensor 58', is verified by the marker 59'. The individual drive gears 47 of the units can then be appropriately set, for example by loosening screws 154 (FIG. 9A) so that the line shaft and the respective unit shafts will be in synchronism. When hunting the line shaft to zero or null, the auxiliary low-power, for example 3 HP, drive motor can be used to rotate the line shaft at a creep speed.

Figure 13:
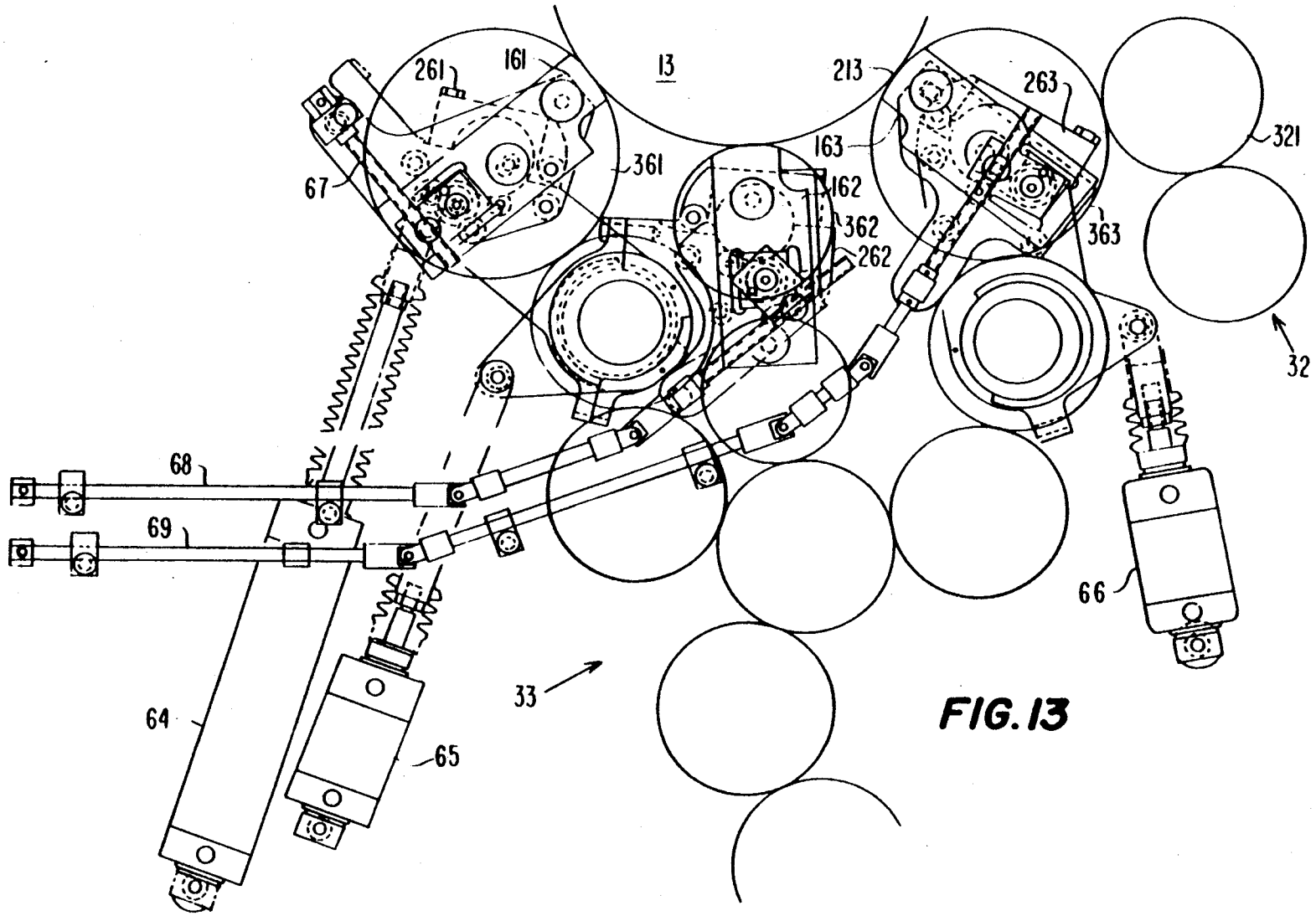
FIG. 13 is a highly schematic view, to an enlarged scale, illustrating the adjustment linkage for the ink application rollers or cylinders.

In accordance with a feature of the invention, it is not necessary to reset the ink application rollers 361, 362, 363 when cartridges of different cut-off sizes are sequentially installed. Referring now to FIG. 13: Three air cylinders 64, 65, 66 pneumatically apply pressure against the respective rollers 261, 362, 363. Adjustment linkages 67, 68, 69 are coupled between the air cylinders 64, 65, 66, and the respective rollers 361, 362, 363. The pneumatic cylinders 64, 65, 66 provide for pneumatic force loading of sliders against a stationary ring 213 which has the same diameter as the gear pitch diameter oif the plate cylinder gear. Each one of the linkage mechanisms include a respective striker plate 161, 162, 163, which is part of a suspension or hanger 261, 262, 263. The respective striker 161, 162, 163 moves in a straight line against the ring 213. Thus, the same relationship of the respective ink application rollers to the particular installed plate cylinder installed in maintained with respect to the respective cylinder gear pitch diameter. FIG. 13 also shows the final dampening liquid application roller 321, in engagement with the ink application roller 363.

The construction of the inker fountain can be in accordance with any usual or customary arrangement. A fountain which is particularly suitable and applicable, especially, for easy exchange of ink troughs, is described in the copending application assigned to the assignee of the present application U.S. Ser. No. 07/897802, filed Jun. 12, 1992, Gelinas et al, entitled "PORTABLE, REMOVABLE INK FOUNTAIN BOX FOR A PRINTING MACHINE".

Figure 10:
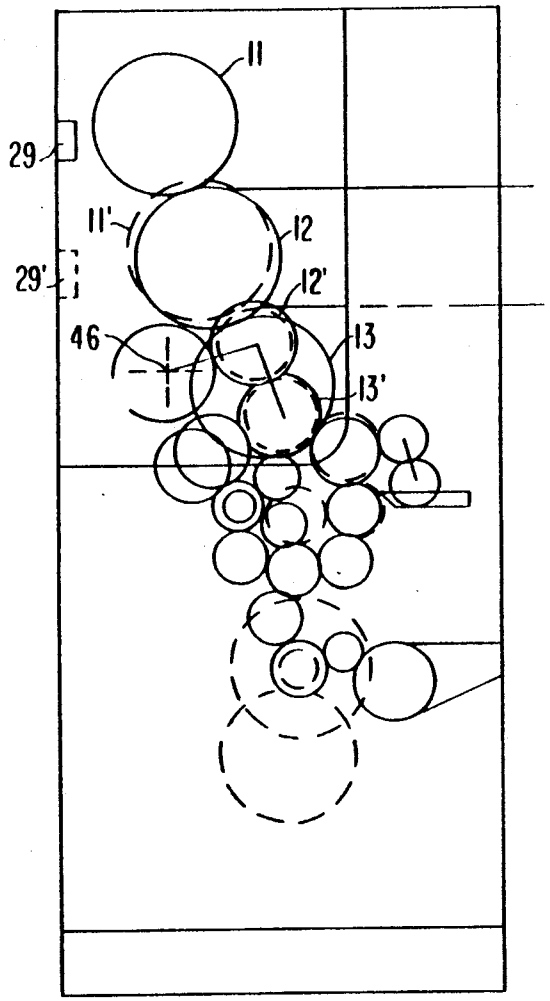
FIG. 10 is a highly schematic side view of the gearing in the tower, including gearing for the inker system and gear clutches for, respectively, engaging cylinders when the plate cylinder is changed from a large-size cylinder (full-line) to a small-size cylinder (broken-line) position, and the blanket cylinder is likewise changed.
Figure 11:
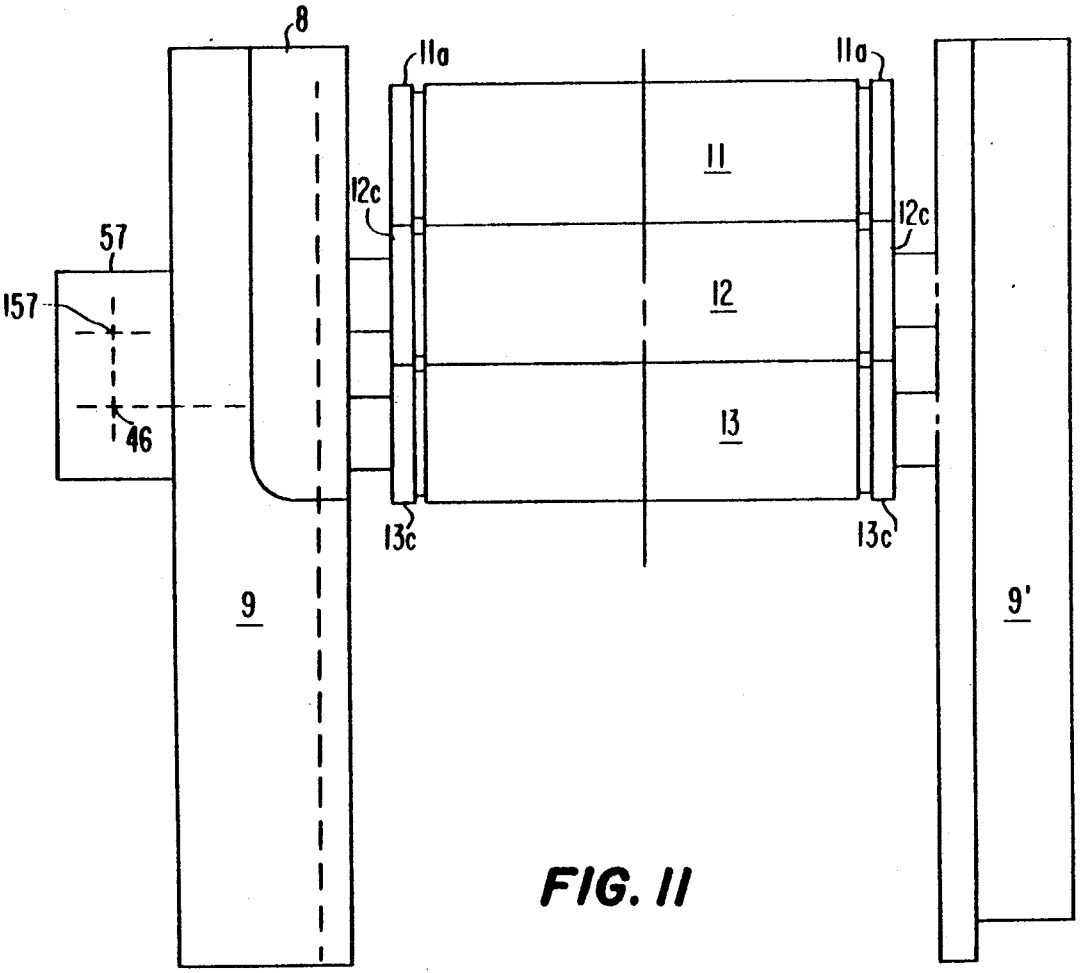
FIG. 11 is a schematic side view illustrating the position of the cassette in the tower structure, in which the outline of the cassette portion at the work side of the machine has been omitted.

FIG. 10, highly schematically, illustrates the gearing and the position of the impression cylinder 11, for a maximum diameter blanket cylinder 12 and plate cylinder 13, in full-line position. Superimposed are the positions of the impression cylinder 11', plate blanket cylinder 12' and plate cylinder 13', for minimum sizes shown in broken lines. Of course, the size of the impression cylinder 11 will not change. Since the impression cylinder bearer setting unit 29 is part of the cartridge or cassette, the arm 22 can bring the impression cylinder to the position 11'; the bearer setting unit is then located at the position 29', as shown in FIG. 10, for a cassette of minimum cartridge cut-off size, that is, for cartridges holding printing cylinders of minimum size. FIG. 10 clearly shows that the ink application rollers are engageable against the plate cylinder 13 as well as against plate cylinder 13'. Cylinders 12 and 13, or 12', 13', respectively, are coupled by gears not visible in FIGS. 10 and 11. Gear 46 can be engaged with a cylinder gear by relative axial shifting, when the timing has been established, or, respectively, disengaged.

Only those elements material to an understanding of the present invention have been described in detail and identified by reference numerals. Various other elements and structural components, as well as control systems, control connections and the like, sensors, position sensing switches, positioning units and servo arrangements, whether electric, hydraulic or pneumatic, may be used, as well known in the printing machinery construction field. Some of those elements may be shown in the drawings, although not specifically identified, and their use and installation will be clear to those skilled in the art; examples are the various ink transmission rollers and cylinders of the ink train 33, the specific form of the inker, the dampener 32, and structural components, microswitches, of which two are shown at 122 in FIG. 4, and interlocks to ensure that the printing machine can start and operate only when the cassettes are in appropriate position, locked in place, and the respective cylinders appropriately timed. Sequencing controls, well known in electrical control systems, with interlock circuits, can be used as appropriate.

The linkages 67, 68, 69 are used to position the centers of the respective rollers 361, 362, 363, when the rollers are exchanged, for example due to wear and tear. Rather than using the universal joint linkages on the links 68, 69, flexible cables or the like can be used. The adjustment linkage for roller 361 is readily accessible and does not need the more complex adjustment system for rollers 362 and 363.

We claim:

1. A versatile printing machine system for use with printing cylinders of different cut-off sizes, especially for printing on a web (W) of heavy or thick stock material, having at least one printing station (1–6), the at least one printing station including a printing tower (9, 9');

an impression cylinder (11) located and retained in an upper part of the printing tower;

a printing cylinder (12, 13) carrying a printing image, said web (W) being conducted between the impression cylinder (11) and the printing cylinder (12, 13);

an inker (33) located and retained in the printing tower below the printing cylinder;

a removable cassette (8) selectively attachable and removable from the printing tower (9, 9'), the printing cylinder (12, 13) being retained in said cassette (8) and positioned below the impression cylinder, said cassette, when located in the printing tower, positioning the printing cylinder in ink-receiving position with respect to the inker retained in the tower;

positioning means (8*a*, 19) on the cassette (8) and on the tower (9, 9'), respectively, for selective positioning of the cassette in the tower, while permitting removal in a movement path extending, at least in part, upwardly from the plane of the web when conducted through the printing station; and overhead hoist means (15, 17) engageable with the cassette (8) for removing the cassette from the printing tower in said movement path (15*b*).

2. The system of claim 1, wherein the printing cylinder comprises a blanket cylinder (12)-plate cylinder (13) combination;

gear means (47) on at least one of said cylinders of the combination, and forming part of the cassette (8); and drive gear means (46, 157) forming part of the tower, selectively engageable with, and disengageable from the gear means (47) of the cassette.

3. The system of claim 1, wherein the impression cylinder includes an associated bearer ring (11*a*), and impression cylinder bearer ring-impression cylinder adjustment means (30, 31) are provided, controllably adjusting the relative position of the impression cylinder bearer ring (11*a*) with respect to the impression cylinder (11); and bearer ring setting means (29) forming part of the cassette (8) determining the position of the bearer ring with respect to the printing cylinder (12, 13) in the cassette, so that, upon adjusting said relative position of the bearer ring (11*a*) and the impression cylinder (11), the resulting nip between the impression cylinder (11) and the printing cylinder can be adjusted to accomodate webs (W) of different thicknesses.

4. The system of claim 3, further including an impression cylinder support arm (22) retained on the printing tower, the impression cylinder bearer ring (11*a*) being located on the support arm in a predetermined position; and wherein the bearer ring setting means (29) includes engagement means releasably positioning said support arm (22) when the cassette (8) is located in the printing tower (9).

5. The system of claim 1, further including an impression cylinder support arm (22) supporting the impression cylinder (11), said support arm being retained on the printing tower (9);

movable pivot means (23, 23*a*) pivotably supporting the support arm on the printing tower (9);

throw-off control means (284); and means (23*a*) for controlling the position of the movable pivot means (23) in dependence on whether the throw-off control means is in print-ON or throw-OFF position.

6. The system of claim 5, further comprising printing cylinder throw-off linkage means (26, 281) coupled to the printing cylinder (12, 13); and severable coupling means (282, 283) coupling the printing cylinder throw-off linkage means to the throw-off control means (284) to effect simultaneous throw-off of the impression cylinder and of the printing cylinder upon operation of the throw-off control means, when the cassette is installed in the tower, while permitting removal of the cassette (8) including the throw-off linkage means.

7. The system of claim 6, wherein the severable coupling means comprises two selectively engageable and disengageable gear means, one of the gear means being connected to the throw-off control means (284) and the other to the throw-off linkage means (26, 281) to selectively transfer rotary movement of the throw-off control means to permit severing of the linkage means upon removal of the cassette.

8. The system of claim 6, further including (FIG. 7) bearer wipers (41, 43, 141; 42, 44, 142) selectively engageable against bearer rings (12*c*, 13*c*) on the printing cylinder (12, 13); and bearer wiper operating means (39, 40) coupled to the throw-off linkage means (26, 281) and simultaneously engaging the bearer wipers for engagement with the respective bearers (12*c*, 13*c*) when the throw-off linkage means are in print-ON position.

9. The system of claim 1, further including an impression cylinder support arm (22) retained on the printing tower (9), and supporting the impression cylinder (11); and lifting means (24, 24*a*, 124) on the printing tower, engageable with the support arm (22) for raising the support arm and swinging it, together with the impression cylinder, out of the way of the cassette to permit removal of the cassette.

10. The system of claim 1, wherein (FIGS. 9 and 12) the printing machine system has a main drive shaft (157);

the printing cylinder has a drive shaft (54); and shaft timing setting means are provided, coupled to the printing cylinder drive shaft (54) and the main drive shaft (157), respectively, said timing means including a rotatable shiftable disk (49, 50, 59*a*) on one of said shafts;

marker means (55, 55', 56; 59, 59') on the disk; and sensors (48, 58, 58') secured to the tower and positioned in sensing relation to said disk, said sensors evaluating the relative position of the shaft and the disk and, upon rotatably shifting the disk, determining a zero or reference setting of the respective shaft in relation to the position of the sensors on the tower.

11. The system of claim 10, wherein (FIG. 9) the printing cylinder comprises a blanket cylinder (12) - plate cylinder (13) combination;

gear means (47) on at least one of said cylinders of the combination, and forming part of the cassette (8); and drive gear means (46, 157) forming part of the tower, selectively engageable with, and disengageable from the gear means (47) of the cassette;

and wherein the rotatable shiftable disk is secured to the plate cylinder (54); and including a plate cylinder gap positioning disk (49) having a gap positioning marker (58), one of the sensors being responsive to the gap positioning marker to determine a predetermined circumferential position of the plate cylinder in the cassette (8) when the system is stopped and prior to removal of the cassette (8) from the tower (9).

12. The system of claim 1, wherein (FIG. 13) the cassette (8) includes a ring element (213) concentric with the printing cylinder (12, 13); and wherein the inker (33) includes at least one ink application roller (361, 363);

feeler means (161, 162, 163) located on the tower (9) engageable against said ring element (213) when the cassette is installed in the tower;

biassing means (64, 65, 66) coupled to the at least one ink application roller and exerting a biassing force on the respective roller towards the printing cylinder; and movable control means (261, 262, 263) coupled to the feeler means (161, 162, 163) and to the at least one ink application roller for controlling movement of the respective ink application roller in radial direction with respect to said ring element under the bias force exerted by the bias means.

13. The system of claim 12, including a printing cylinder gear coupled to the printing cylinder; and wherein the ring element (213) has a circumference which has the same diameter as the gear pitch diameter of the printing cylinder gear.

14. The system of claim 12, wherein the printing cylinder comprises a blanket cylinder (12) - plate cylinder (13) combination;

gear means (47) on at least one of said cylinders of the combination, and forming part of the cassette (8); and drive gear means (46, 157) forming part of the tower, selectively engageable with, and disengageable from the gear means (47) of the cassette;

wherein the plate cylinder (13) of the blanket cylinder - plate cylinder combination includes a plate cylinder gear; and wherein the ring element (13) is stationary in the cassette and has a circumference which has the same diameter as the gear pitch diameter of the plate cylinder gear.

15. The system of claim 1, wherein the impression cylinder includes an associated beared ring (11*a*);

bearer ring setting means (29) are provided, secured to the cassette (8), and forming part of the cassette for determining the position of the bearer ring with respect to the printing cylinder (12, 13) in the cassette; and an impression cylinder support arm (22) is provided, retained in the printing tower (9); and pivot means (23) privotably supporting the support arm (22) in the printing tower for pivoting movement as well as translatory movement;

said support arm (22) privoted in the tower (9) and the bearer ring setting means (29) on the cassette including a coupling means (22*b*, 129) for coupling together the support arm and the bearer ring setting means when the cassette is installed in the tower (9) and to control the setting of the bearer ring (11*a*) on the support arm with respect to the printing cylinder in the cassette.

16. The system of claim 15, wherein the printing cylinder comprises a blanket cylinder (12) - plate cylinder (13) combination;

gear means (47) on at least one of said cylinders of the combination or couple, and forming part of the cassette (8); and drive gear means (46, 157) forming part of the tower, selectively engageable with, and disengageable from the gear means (47) of the cassette;

and wherein the bearer ring setting means controls the setting of the bearer ring (11*a*) on the support arm with respect to the blanket cylinder (12) of the blanket cylinder - plate cylinder combination.

17. A printing system, especially for printing on a web (W) of heavy or stock material, having a plurality of printing stations (1–6), each station being located in a printing tower and including a printing cylinder (12, 13) carrying a printing image;

an impression cylinder (11), said printing cylinder printing on the web, when the web is guided between the printing cylinder and the impression cylinder;

movable impression cylinder retention means (22, 30) retaining said impression cylinder in the printing tower (9);

a cassette (8) removably located on the printing tower;

movable printing cylinder holding means (26, 281) located in the cassette (8);

movement control means (284) located in the tower (9);

separable coupling means (282, 283) coupling the movement control means to the printing cylinder holding means, said movement control means controlling (a) the position of the printing cylinder holding means (26, 281) in the cassette (8), and (b) the position of the impression cylinder (11) in the tower, to thereby determine the relative position of the printing cylinder (12, 13) within the cassette, when installed in the tower, in relation to the impression cylinder (11) to permit, upon operation of the movement control means, to simultaneously throw off the printing cylinder and the impression cylinder by a single movement control means.

18. The system of claim 16, including an inmpression cylinder bearer ring (11*a*);

adjustment means (30, 31) relatively adjusting the position of the impression cylinder (11) with respect to the impression cylinder bearer ring;

impression cylinder bearer ring position control means (29) located on the cassette; and engagement means (22*b*) coupled to the movable inpression cylinder retention means (22, 30) engageable with said bearer ring setting means when the cassette is installed in the tower (9) to determine the position of the impression cylinder with respect to the printing cylinder in the cassette subject to control of the instantaneous position of the impression cylinder and the printing cylinder as controlled by said movement control means.

19. The system of claim 17, wherein the printing tower is formed with a cassette receiving surface (19);

the cassette is formed with a printing tower engagement surface fitting against said cassette receiving surface; and wherein one (19) of said surfaces is formed with an essentially continuous groove or slot (20) and a closed inflatable tube or hose (21) is provided, located in said groove or slot, and adapted for pneumatic pressurization, said inflatable tube or hose (21) being formed with a rib (21*a*) projecting from the respective surface in which said tube or hose is placed towards the other surface to form a yielding seal against that other surface, when pneumatically pressurized.

* * * * *